US007219459B2

(12) United States Patent
Valiulis et al.

(10) Patent No.: US 7,219,459 B2
(45) Date of Patent: May 22, 2007

(54) STRIP RETAILER AND SIGN HOLDER

(75) Inventors: Thomas E. Valiulis, Rockford, IL (US); Joseph E. Gormley, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 128 days.

(21) Appl. No.: 10/859,382

(22) Filed: Jun. 2, 2004

(65) Prior Publication Data

US 2005/0268507 A1 Dec. 8, 2005

(51) Int. Cl.
*B65D 73/00* (2006.01)

(52) U.S. Cl. ..... 40/673; 211/113; 206/806

(58) Field of Classification Search ..... 40/673, 40/651; 206/806, 461, 466; 311/113
See application file for complete search history.

(56) References Cited

U.S. PATENT DOCUMENTS

| | | | | | |
|---|---|---|---|---|---|
| 918,372 | A * | 4/1909 | Rohr | 206/362.1 |
| 3,167,178 | A * | 1/1965 | Saunders | 206/361 |
| 3,884,350 | A * | 5/1975 | Johansson | 229/122 |
| 4,483,502 | A * | 11/1984 | Fast | 248/223.41 |
| 4,573,590 | A * | 3/1986 | Ellis | 211/85.15 |
| 5,284,259 | A * | 2/1994 | Conway et al. | 211/73 |
| 5,386,916 | A | 2/1995 | Valiulis | 211/113 |
| 5,682,698 | A | 11/1997 | Bevins | 40/661.03 |
| 5,683,003 | A | 11/1997 | Gebka | 211/57.1 |
| 5,743,403 | A | 4/1998 | Crysdale | 206/482 |
| 5,957,422 | A | 9/1999 | Shea | 248/220.31 |
| 6,076,685 | A * | 6/2000 | Ramirez | 211/13.1 |
| 6,145,232 | A | 11/2000 | Bevins | 40/661.03 |
| 6,145,675 | A | 11/2000 | Kass et al. | 211/71.01 |
| 6,276,540 | B1 * | 8/2001 | Skuro | 211/85.3 |
| 6,286,690 | B1 | 9/2001 | Thalenfeld | 211/113 |
| 6,651,369 | B1 | 11/2003 | Keating et al. | 40/658 |
| D486,021 | S * | 2/2004 | Dion | D6/553 |
| 6,698,124 | B2 | 3/2004 | Kump et al. | 40/642.02 |
| 6,708,436 | B2 | 3/2004 | Nagel | 40/666 |
| 2003/0196974 | A1 * | 10/2003 | Cuzzocrea | 211/113 |

OTHER PUBLICATIONS

The Brenmar Company, Shelving: Swivel Strip Holder, www.brenmarco.com, May 15, 2004.
Clip Strip Corp., Sign Holders (Catalog Shop), www.clipstrip.com, May 15, 2004.
Fast Industries, Product Catalog (partial), www.fastindustries.com, May 16, 2004.

* cited by examiner

*Primary Examiner*—Cassandra Davis
(74) *Attorney, Agent, or Firm*—Baker & McKenzie LLP; David I. Roche

(57) ABSTRACT

A combination sign holder and strip retailer for provided expanded area for graphics and detailed information about products offered for sale on the strip retailer. The sign holder portion of the combination has an opening at or near the bottom thereof to accommodate the passage of a plastic strip retailer (die-cut or injection molded) through the opening. An enlarged portion of the strip retailer is retained on opposite sides of the opening. The sign holder portion of the combination may be made of a heat-folded PVC having an additional third panel that allows the sign holder to be held by a C-shaped price channel on a store shelf. Alternatively, an adhesive strip or hooks extending through holes in the sign holder may be used to fasten the combination to a retail fixture.

8 Claims, 2 Drawing Sheets

STRIP RETAILER AND SIGN HOLDER

BACKGROUND AND SUMMARY OF THE INVENTION

The inventions described and claimed herein relate to holders for signs and strip retailers that hold products for sale in retail stores. In particular, the holder described herein is for strip retailers (sometimes called "strip clips" or "strip merchandisers").

Strip retailers are an important tool for retail stores to present special or impulse items to customers. It is important to support the strip retailer in secure manner, and to have appropriate signage for pricing or other descriptive information directly adjacent to items offered for sale with the strip retailer.

Some strip retailers have a small integral sign holder in the form of a slightly enlarged upper ends that provide limited place for information about the products that are attached to the strip by clips. An example of a slightly enlarged integral sign holder can be seen in U.S. Pat. No. 5,957,422 (Shea) and U.S. Pat. No. 6,145,675 (Kass et al). Such integral sign holders are typically small and designed to accommodate only adhesive labels, i.e., they do not have pouches with a place for removable signage. In other instances, signage for the items offered in a strip retailer are attached to support arms that extend from a shelf (see U.S. Pat. No. 5,386,916 (Valiulis) and U.S. Pat. No. 5,683,003 (Gebka)) or by totally separate sign supporting structures (see U.S. Pat. No. 6,698,124 (Kump)).

Strip retailers are attached to shelves in retail stores in various ways. One such way is by a simple hook extending through a hole in the upper end of the strip retailer. See U.S. Pat. No. 5,743,403 (Crysdale). Examples of more complex devices used to support strip retailers can be seen in U.S. Pat. No. 6,698,124 (Kump) and U.S. Pat. No. 5,386,916 (Valiulis), U.S. Pat. No. 5,683,003 (Gebka) and U.S. Pat. No. 5,957,422 (Shea).

BRIEF SUMMARY OF AN EXAMPLE OF THE INVENTIONS

The following is a brief summary of some aspects of the inventions set forth in the appended claims, as described with respect to particular examples of how the inventions might be implemented. This summary, however, is not intended to and should not be used as a substitute for a definition of the boundaries, scope or limits of the inventions as set forth in the claims.

The devices shown in the figures and described below in the detailed description provide a retailer with a convenient and inexpensive way to attach a strip retailer to a shelf and to provide an expanded area for signage that may be associated with the products offered on the strip retailer. A pair of panels (formed from a single folded sheet or formed by welding two or more sheets together) are connected by a connection path at a lower part of the panels. The connection path has an opening formed in it for allowing a strip retailer to extend through the opening. An enlarged upper part of the strip retailer engages and his held by the connection between the panels on opposite sides of the opening. Signage may be placed between and is held by the pair of panels. The panels may be attached to a shelf, the side of a shelf or partition or other support structure either by a simple hook, a string, a wire, a plastic wire tie or other fastener extending through a small hole in one or more of the panels, or by a plastic push pin fastener, an adhesive, or by a third panel formed as an extension of the front one of the pair of panels. The third panel should be made of a somewhat rigid material and dimensioned so as to fit securely in to a C-shaped price channel on the edge of a shelf.

DETAILED DESCRIPTION OF THE DRAWINGS

Figure 1:
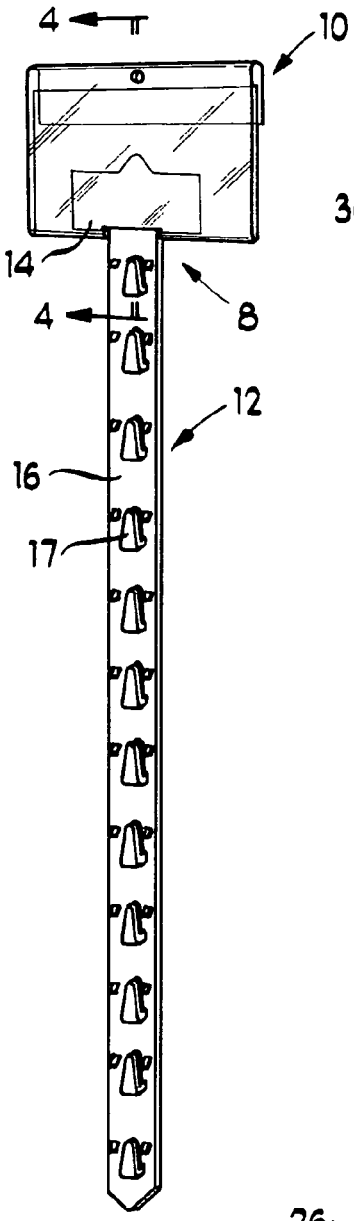
FIG. 1 is a perspective view of a strip retailer held by a sign holder as described and claimed in more detail below.
Figure 2:
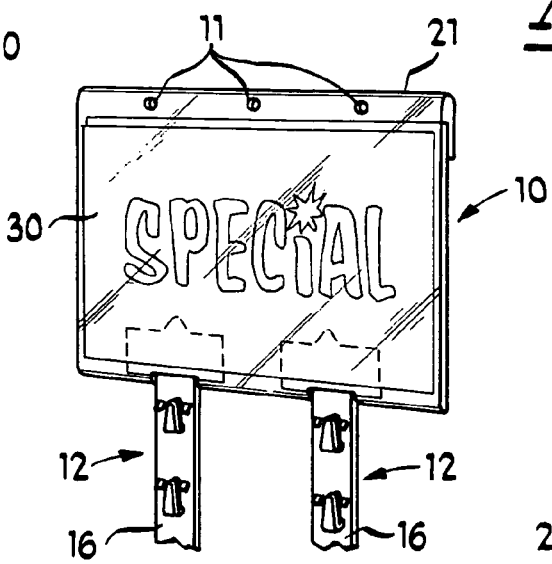
FIG. 2 is an enlarged perspective view of a holder in which two strip retailers are held adjacent to one another.
Figure 4:
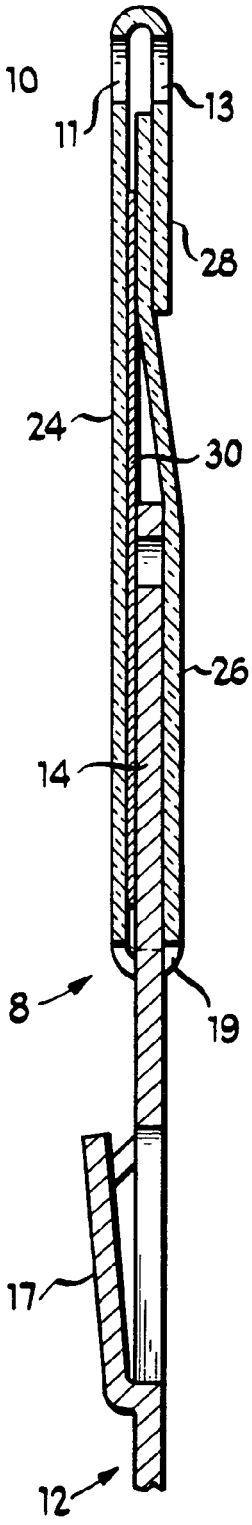
FIG. 4 is a longitudinal partial section taken along line 4—4 in FIG. 1.

FIG. 1 shows a sign holder 10 with a strip retailer 12 inserted partially through it to form a holder/strip combination 8. The strip retailer 12 has an enlarged or widened upper part 14 and a narrower lower part 16 containing a plurality of integral hooks 17. The front panel 24 is hingedly connected by a connecting path 18 to a rear panel 26. Similarly, the front panel 24 is hingedly connected to a third panel 28. The third panel 28 serves as an attachment panel, when the combination 8 is used with a shelf having a C-shaped price channel. As can be seen in more detail from FIGS. 2 through 4, the sign holder 10 includes one or more holes 11 formed in the upper part of the front panel 24. The third panel has a matching hole (or holes) 13 in its upper part.

A sign (which may be a cardboard, other sheet or anything capable of showing graphical information) is disposed between the front panel 24 and the rear panel 26 such that the sign covers (i.e., is in front of) the enlarged upper part 14 of the strip retailer 12. The sign 30 may be inserted at the same time that the strip retailer 12 is inserted into the opening 19, or may be inserted later, after the sign holder 10 has been attached to a shelf in a store.

The connecting path 18, in the embodiments shown herein, is in the form of a fold or hinge 15 between the front panel 24 and the rear panel 26. The opening 19 lies along the connecting path 18 such that the path 18 is divided into a first part 20 and a second part 22. The portions of the connecting path 18 which are disposed on opposite sides of the opening 19 engage the enlarged upper part 14 of the strip retailer 12 after the narrow part 16 of the strip retailer 12 is inserted through the opening 19.

Figure 5:
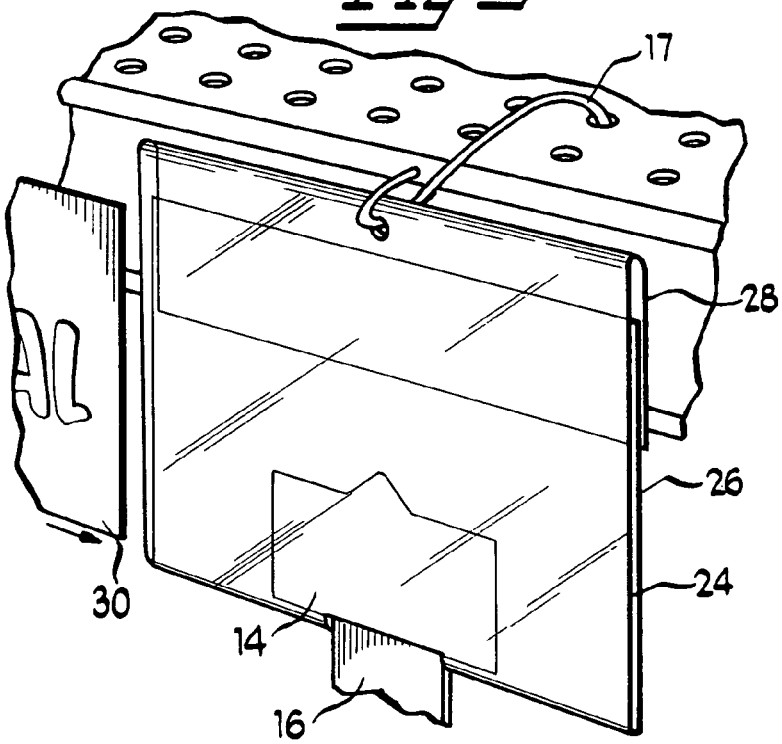
FIG. 5 is a perspective view of a strip retailer and sign holder attached to a shelf by a hook.

FIGS. 5 through 8 depict ways in which the combination 8 of the sign holder 10 and strip retailer 12 may be attached to a shelf in a store 32. In FIG. 5, a hook 17 passes through the holes 11 and 13 in the front and third panels, respectively. The sign 30 may be inserted after the hook 17 engages the shelf and the sign holder 10 to provide information about the products that are held on the strip retailer 12.

Figure 6:
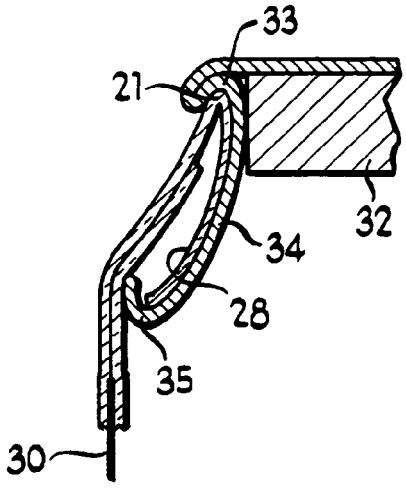
FIGS. 6 and 7 are enlarged cross-sectional views of a holder held in two different C-shaped price channels by a panel that is an extension of a front panel of the sign holder.

FIG. 6 shows an angled C-shaped price channel 34 on the front edge of a shelf 32. The third panel 28 has a free, exposed lower edge such that the third panel 28 is a flap capable of being fixedly connected to a C-shaped price channel in an over-center manner. Constructing the combination 8 of material such as heat folded 15 mil PVC will allow the third panel to fixedly hold the sign holder 10 and one or more strip retailers in place as an extension of the shelf 32.

Figure 7:
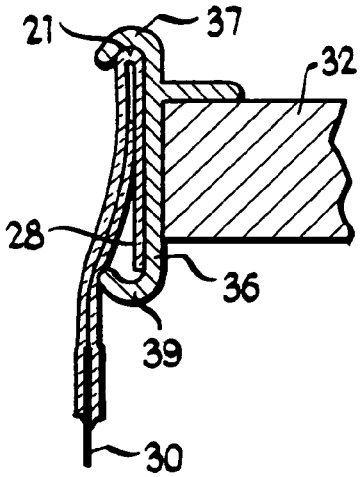

The third panel 28 and the upper hinge 21 cooperate with the C-shaped price channel 34 to securely support the combination holder 8 in place. The lower edge 29 of the rear panel 28 and the upper hinge 21 are preferably slightly longer than the distance between the upper part 33 and lower part 35 of the curved channel 34, which allows the third panel 28 to be gripped by the channel 34. Similarly, FIG. 7 shows a vertically oriented flat C-shaped price channel 36 attached to the front edge of a shelf 32. Again, the upper hinge 20 fits snugly into the upper part 37 of the channel 36 and the lower part of the third panel 28 engages the lower part 39 of the channel 36 to securely hold the combination holder 8 in place.

Figure 8:
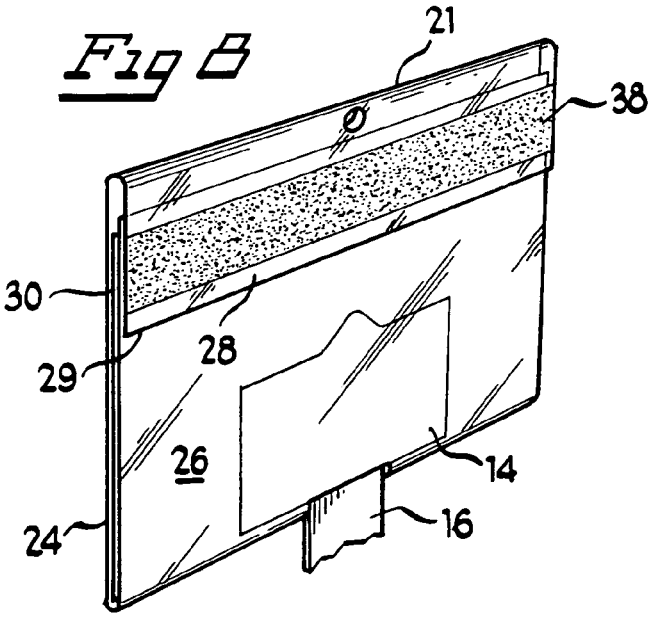
FIG. 8 is a perspective view of a combination strip retailer and sign holder having an adhesive strip on its upper rear portion for attachment thereof to a shelf.

FIG. 8 depicts a third way of attaching the combination holder 8 to a shelf or other surface. A strip of adhesive 38 is affixed to the exposed side of the third panel 28. It may be desirable for the adhesive strip to be covered with a removable release liner (not shown), so that several combination holders 8 may be shipped without affixing themselves to each other.

Figure 3:
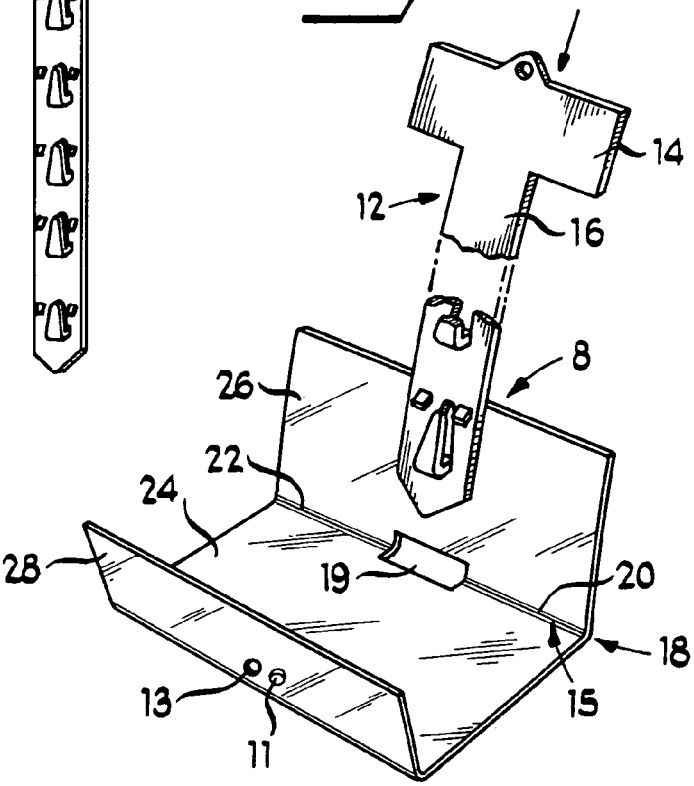
FIG. 3 is an exploded perspective view of a strip retailer being inserted into a sign holder as described and claimed in more detail below.

The sign holder 10, which forms a part of the combination holder 8, is shown in FIGS. 1 through 8 as being formed of a single folded continuous sheet of 15 mil. PVC, which is well suited for certain applications of the inventions described and claimed herein. However, it should be understood that thinner gauge plastic sheets could also be used. For example, two separate sheets of clear vinyl (approximately 10 mils thick) may be joined along their perimeter (three or all four sides, for example), by a heat, mechanical or solvent welding connection or some combination thereof (or some other joining technique) to form a pouch. A holder made of softer more pliable PVC of a thickness less than about 15 mil could be made of two sheets joined on all four sides and may have a first slot for allowing the insertion of a sign into the space between the sheets. The thickness of the material can range from about 5 mil to about 40 mil and can be either rigid or soft. PVC works well, but other materials, including plastics such as PETG, polyester, polypropylene, could be used. Thickness of the material and decision of soft or rigid PVC is determined by the customer as an choice for look and feel within the retail environment. A second opening, such as the opening 19 in the embodiment of FIG. 2, should be formed at or near the lower connecting path between the front and rear sheets. This second opening may be cut or may be left unwelded or otherwise unconnected during the initial connection of the front and rear sheets. In either case the second opening is a discontinuation in the connecting path between the front and rear sheets or panels. The sizes of the upper slot and opening near the lower connecting path should be such that an entire strip retailer can pass through the first slot, and only the narrow clip-bearing part of the strip retailer may fit through the second opening. A hole (perhaps reinforce with a metal ring) with a hook (such as the hook 17 in FIG. 5) would be used to hold the sign holder/strip retailer in place. An opening, similar to the opening 19 along the connection path 18 (as depicted in FIG. 3), may be formed along a lower portion of the clear vinyl pouch. A strip retailer 12, such as the one shown in FIGS. 1 through 5 and 8, may then be inserted through the opening in the bottom of the clear vinyl pouch to provide a sign holder and strip retailer combination similar to the one shown in FIG. 1 or the one shown in FIG. 2. As with the width of the opening 19, as shown in FIG. 3, the lateral dimension of the opening along the connection path between the front and rear sheets should be large enough to allow the narrow portion of the strip retailer to pass through the opening, but should be narrow enough to engage and support an enlarged upper part of the strip retailer.

While the invention has been described with reference to particular embodiments which has been shown in the figures and discussed above, it will be apparent to those skilled in the art that numerous variations, modifications and improvements may be made to the invention described herein without departing from the spirit and scope of the appended claims.

What is claimed is:

1. A holder for use in presenting items for sale comprising a first panel and a second panel, the panels being joined along a connecting path, the path having at least one opening and at least one strip retailer with clips shaped to retain a plurality of pieces of merchandise, the strip retailer having an enlarged generally flat upper portion and a narrower clip-bearing lower portion, the narrow clip-bearing lower portion of the strip retailer extending through the opening in the connecting path, and the enlarged generally flat portion being held between the panels by portions of the connecting path on opposite sides of the opening.

2. A holder in accordance with claim 1 wherein:

an attachment panel in the form of a flap extending from the front panel over and behind the rear panel, the front panel and attachment panel being joined by a hinge, the attachment panel having a stiffness sufficient to be fixedly held in a C-shaped price channel.

3. A holder in accordance with claim 1 wherein:

the front panel and the rear panel define a pouch, the pouch providing a place for holding a sign adjacent to a strip retailer supported in the opening.

4. A holder in accordance with claim 1 wherein:

the connection path has a plurality of openings whereby a plurality of strip retailers may be supported by said holder.

5. A holder in accordance with claim 1 wherein:

the front panel and the rear panel are made of a single folded sheet, and the connecting path is a hinge, and the opening is a slot formed in the vicinity of the hinge.

6. A holder in accordance with claim 1 wherein:

said front panel is comprised of a clear substrate material, ranging in thickness from about 5 mil to about 40 mil, selected from the group consisting of PVC, PETG, polyester and polypropylene.

7. A holder in accordance with claim 1 wherein: the front panel and the rear panel are formed by separate sheets joined by a weld and the connecting path is a weld line.

8. A holder in accordance with claim 1 wherein:

said opening is formed by a discontinuation of the weld line.

* * * * *